US006837281B2

(12) United States Patent
Spiers et al.

(10) Patent No.: US 6,837,281 B2
(45) Date of Patent: Jan. 4, 2005

(54) APPARATUS AND METHOD FOR FILLING CAVITIES WITH METERED AMOUNTS OF GRANULAR PARTICLES

(75) Inventors: Steven F. Spiers, Richmond, VA (US); Martin F. Garthaffner, Chesterfield, VA (US); Gary Atwell, Mechanicsville, VA (US)

(73) Assignee: Philip Morris Incorporation, New York, NY (US)

( * ) Notice: Subject to any disclaimer, the term of this patent is extended or adjusted under 35 U.S.C. 154(b) by 98 days.

(21) Appl. No.: 09/931,376

(22) Filed: Aug. 17, 2001

(65) Prior Publication Data

US 2003/0034085 A1 Feb. 20, 2003

(51) Int. Cl.[7] ..... B65B 1/04; B65B 3/04; B67C 3/02

(52) U.S. Cl. ..... 141/125; 141/67; 141/71; 141/129; 141/286

(58) Field of Search ..... 141/2–7, 11, 12, 141/67, 70, 71, 81, 86, 93, 121–123, 125, 129, 144, 286, 290; 222/152, 368, 636

(56) References Cited

U.S. PATENT DOCUMENTS 2,540,059 A * 1/1951 Stirn et al. ..... 141/1
3,570,557 A 3/1971 Molins
3,837,264 A 9/1974 Sexstone
3,847,064 A 11/1974 Berger
3,884,741 A 5/1975 Sexstone
3,910,166 A 10/1975 Sexstone
4,005,668 A 2/1977 Washington et al.
4,016,830 A 4/1977 Sexstone
4,214,508 A 7/1980 Washington
4,285,677 A 8/1981 Ito et al.
4,509,568 A * 4/1985 Kawaguchi et al. ..... 141/129
4,862,905 A 9/1989 Green, Jr. et al.
5,826,633 A 10/1998 Parks et al.
5,875,824 A * 3/1999 Atwell et al. ..... 141/67

* cited by examiner

*Primary Examiner*—Timothy L. Maust
(74) *Attorney, Agent, or Firm*—Burns, Doane, Swecker & Mathis, LLP

(57) ABSTRACT

A method and apparatus for delivering predetermined amounts of material, the apparatus including a vertical drop chute, a filling chamber, a rotating wheel with pockets, a central stationary drum with at least one vacuum chamber and an air jet, and a vacuum rail for transporting an article underneath the rotating wheel and transferring the particles from pockets in the wheel to cavities in the article. The particles can be carbon or charcoal granules and the article can be a cigarette filter rod.

11 Claims, 2 Drawing Sheets

APPARATUS AND METHOD FOR FILLING CAVITIES WITH METERED AMOUNTS OF GRANULAR PARTICLES

FIELD OF THE INVENTION

The present invention relates generally to methods and apparatus for accurately delivering precisely metered amounts of particulate material repetitively during high speed manufacture of particulate-filled articles of manufacture, and most particularly, to precise, repetitive delivery of granular charcoal in spaces presented during the manufacture of plug-space-plug cigarette filters.

BACKGROUND OF THE INVENTION

Certain articles of manufacture such as charcoal cigarette filters, individual-sized packets of granular food products or condiments, capsuled pharmaceuticals, ammunition and the like require repetitive placement of precisely metered charges of particulate matter at some location along the production-line procession of the articles. During high speed mass production of such articles it is difficult to achieve consistent accurate filling of the desired cavities with the granular particles. In the case of filling cigarette filter cavities with charcoal, it is desirable to avoid excessive pulverization and scattering of the particulate material, while achieving as close to 100 percent fill of the cavities as possible U.S. Pat. No. 5,875,824, which is incorporated by reference herein in its entirety, discloses a method and apparatus for delivering predetermined amounts of material, wherein a metering wheel receives discrete amounts of material from a supply chute, with the discrete amounts of material being transferred from the metering wheel to a transfer wheel, and from the transfer wheel into spaces along a filter rod. As a result of the transfer of particles from one wheel to another, the pockets for receiving the particulate material in the transfer wheel must be larger than the pockets in the metering wheel. This arrangement makes it difficult to achieve 100 percent fill of the cavities in the article receiving particulate material from the transfer wheel.

According to the '824 patent, granular particles of charcoal are drawn from a chute in communication with a reservoir into pockets on a rotating metering wheel. The rim of the metering wheel includes a plurality of equally spaced-apart pockets, each of which is defined by a radially directed, conical bore and a discrete screen at the base of the conical bore. The conical bore is convergent in the radially inward direction. A radially directed channel within the rim of the metering wheel communicates a backside of the screen with the interior of the metering wheel. A vacuum can be communicated from a stationary vacuum plenum in the interior of the metering wheel through the radial channel and screen such that any granular particles of charcoal that are adjacent the pocket in the metering wheel will be drawn into the conical bore of the pocket until it is filled.

The provision of discrete screens at the base of each conical bore creates assembly problems and increases the expense of the system taught by the '824 patent. The individual screens can also restrict airflow into the pockets to an undesirable extent.

SUMMARY OF THE INVENTION

An embodiment of the invention provides a method and apparatus for inserting granular particles of carbon or other materials into cavities defined in an article or plurality of articles, such as a cigarette filter rod, with the cavities being spaced at predetermined intervals. In the case of a cigarette filter rod, the cavities are spaced along the filter rod between filter components. In alternative embodiments the method and apparatus could include inserting particles or granules of other materials such as pharmaceuticals into cavities spaced along an article or in discrete articles such as individual capsules. A filling system is provided adjacent a single rotating wheel with spaced pockets that can be connected to a central stationary vacuum. The rotating wheel includes pockets spaced around its outer surface, and a perforated metal band or screen which is clamped against the internal circumferential surface of the rotating wheel by a flexible segmented ring. The flexible segmented ring rotates with the wheel and has openings therethrough that coincide with the pockets around the outer surface of the rotating wheel. Each of the pockets is provided with a conical shape, diverging radially inwardly until terminating at the perforated band or screen that is clamped against the inner circumference of the rotating wheel.

A stationary vacuum plenum is provided in a drum radially inwardly from the rotating wheel and extending along an arc having a length coinciding with the distance between a point at which it is desired to provide vacuum to a pocket to draw in particles and a point at which it is desired to release the vacuum so that the particles can be released from the pocket.

The filling system adjacent to the rotating wheel includes a vertical drop chute with a height that is determined such that the particles accelerate under gravity through the drop chute and are traveling at approximately the surface speed of the rotating wheel when the particles enter the filling chamber. The filling chamber includes openings at the top to receive the particles from the vertical drop chute, at the bottom so that excess particles can drop out of the bottom of the filling chamber to be captured and recycled, and on the side of the filling chamber facing the rotating wheel. The side of the filling chamber opposite from the rotating wheel is provided with air inlets to allow cross air flow through the filling chamber and into the pockets of the rotating wheel. The filling chamber can also be provided with optional deflector vanes to assist in deflecting the particles into the wheel pockets. As particles enter the top of the filling chamber from the vertical drop chute, cross air flow produced by the wheel vacuum and the inlets in the side of the filling chamber opposite from the wheel, direct the particles toward the wheel. The vacuum created by the stationary internal vacuum plenum pulls the particles into the wheel pockets until the pockets are full. A scraper can be provided at the bottom of the filling chamber to scrap the outer surface of the wheel, thereby ensuring that each wheel pocket is accurately filled. A stationary air jet can also be provided inside the rotating wheel at a position adjacent the end of the vacuum plenum in the direction of rotation of the rotating wheel. The air jet directs a blast of air radially outwardly to assist in rapidly emptying each pocket of the rotating wheel as it rotates past the end of the vacuum plenum.

The cavities to be filled with the granules or particles are passed underneath the rotating wheel and their movement is synchronized with the movement of the rotating wheel so that each cavity to be filled coincides with a pocket on the outer surface of the rotating wheel. A vacuum rail for conveying the article or articles having the cavities to be filled can also be provided. The material in which the cavities are formed can be a porous material that allows the vacuum from the vacuum rail to create a negative pressure in the cavities. An example of such a porous material is the paper used in forming cigarette filter rods. The vacuum rail can also be provided with separate chambers having higher and lower amounts of vacuum such that a chamber having the higher vacuum coincides with the cavity that is being filled with particles from the rotating wheel, while the other areas of the article coincide with the chambers having lower vacuum. The use of a high vacuum section in the vacuum rail at the point of particle transfer, and low vacuum at other points allows for quicker transfer of particles at the transfer point without having to adjust the rate at which the cavities are moved underneath the rotating wheel.

The pockets in the outer surface of the rotating wheel diverge radially inwardly, thus getting wider at the bottom of each pocket, in order to resist the effects of centrifugal force created by the rotation of the wheel and to allow a deeper pocket depth to hold more particles. The use of only one wheel to both meter the particles and transfer the particles to cavities in an article overcomes a problem in the prior art wherein progressively larger pockets are required for metering and transfer of particles with more than one wheel. The use of a single wheel allows use of a larger pocket size to achieve 100 percent fill of the cavities in an article.

BRIEF DESCRIPTION OF THE DRAWINGS

The invention will be better understood upon consideration of the following detailed description, taken in conjunction with the accompanying drawings, in which like parts are referred to with the same reference numeral, and in which.

DESCRIPTION OF PREFERRED EMBODIMENTS

The invention provides a system useful for transferring accurately metered volumes of particles to cavities in an article or articles being produced at a high rate during mass production. The system includes a single wheel that rotates around a central stationary drum defining at least one vacuum chamber. A series of pockets are defined along an outer circumferential surface of the rotating wheel between the outer periphery of the wheel and a perforated band or screen that is clamped against the inner periphery of the wheel, to both accurately meter and transfer predetermined amounts of granules or particles into cavities of one or more articles. Accurate metering and transfer of particles is achieved through the use of a combination of features that include a filling system that uses gravitational acceleration of the particles and cross air flow to achieve rapid filling of the pockets in the rotating vacuum wheel, and a vacuum rail for transporting the article or articles that is used in conjunction with an air jet located inside the rotating wheel to ensure rapid emptying of the pockets in the rotating wheel and accurate filling of the cavities in the article moved by the vacuum rail.

Figure 1:
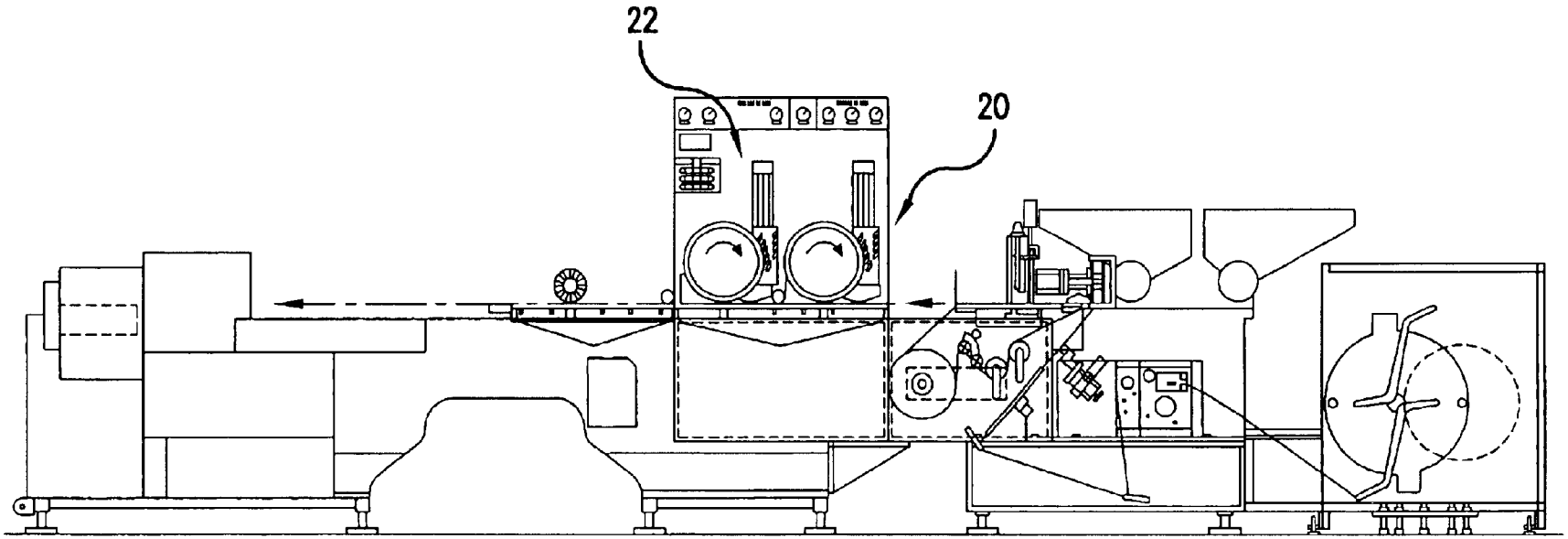
FIG. 1 illustrates a system for producing cigarette filter rods having two particle insertion points.

FIG. 1 illustrates an assembly line for producing cigarette filter rods. A hopper section delivers a filter rod with a filter component—empty cavity—filter component to a downstream section where two filling stations are shown. The paper wrapped around the filter rod is left open at the top side of the filter rod as the filter rod passes by the filling stations. Particles and granules of charcoal are inserted into the spaced cavities along the filter rod through the openings on the top side of the filter rod as the rod passes under the insertion stations. A first insertion station can be used to partially fill or completely fill a cavity, and then the second insertion station can top off the partially filled cavity or a filled cavity that has been compacted, or in which the particles have settled between the first and second insertion stations. After the rod leaves the insertion stations and continues to travel to the left in FIG. 1, a cleaning system removes scattered particles from the surface of the filter components spaced in between the particle filled cavities. After the filter rod leaves the cleaning section, the paper that has been left open at the top of the filter rod is folded over the filter components and particle filled cavities and glued and sealed to complete the filter rod.

Figure 2:
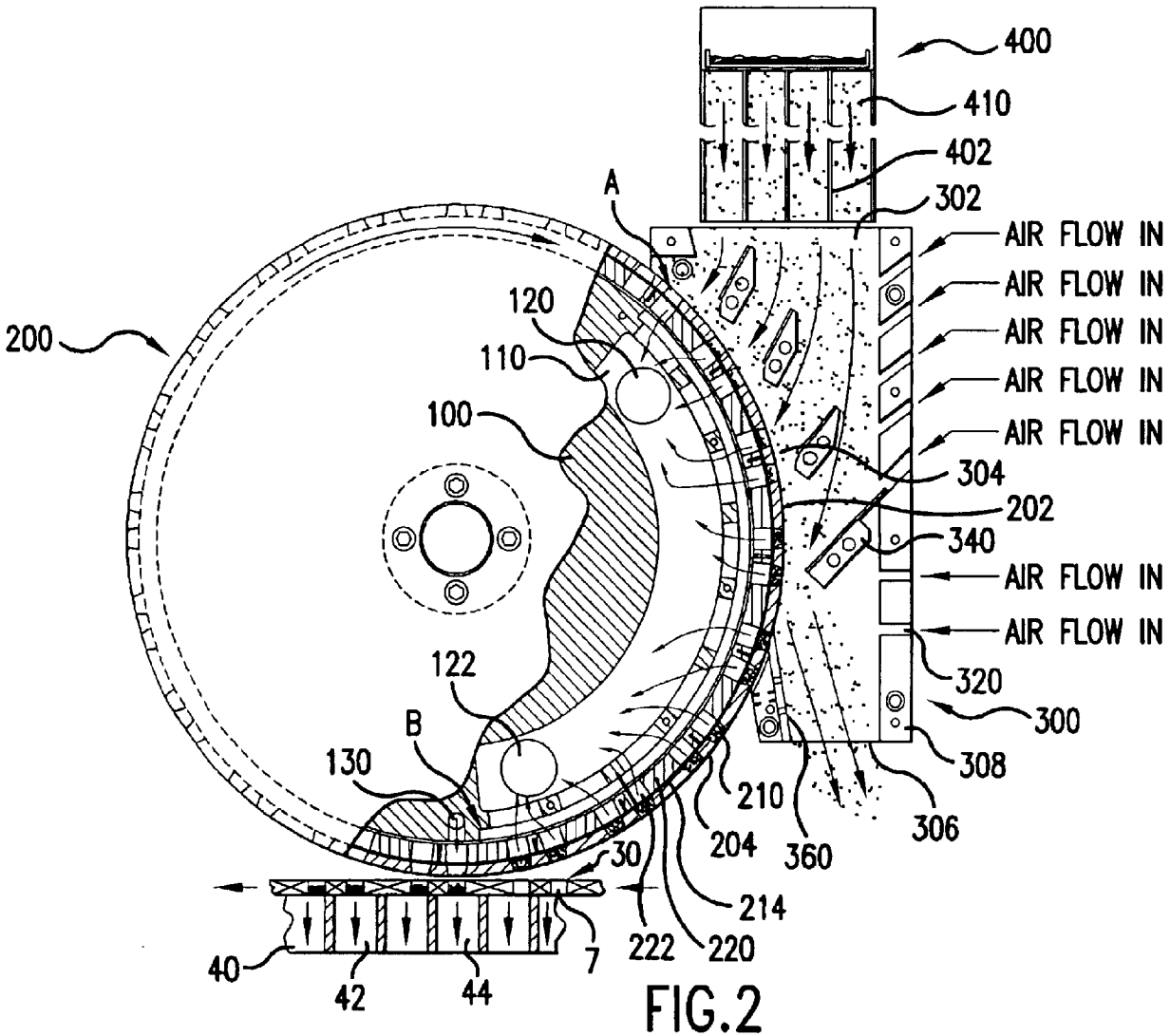
FIG. 2 illustrates a single particle inserter including a vertical drop chute, a filling chamber, a rotating wheel around a stationary vacuum manifold, and a vacuum rail for transporting an article with cavities to be filled.

In an embodiment of the invention illustrated in FIG. 2, a vacuum wheel 200 includes an outer rotating wheel 204 and a stationary central drum 100 defining at least one stationary vacuum plenum 110. A vacuum is maintained in vacuum plenum 110 through vacuum ports 120, 122. A stationary air jet 130 can also be provided in the central stationary drum 100, adjacent one end of the vacuum plenum in the direction of rotation of the rotating wheel 204. The vacuum plenum 110 extends along an arc for a length corresponding to the distance between a point A where particles are provided to a pocket 210 in the outer rotating wheel 204, and a point B where the vacuum holding particles in the pocket 210 is released so that the particles can be filled into a cavity 7 in an article 30 that is being transported underneath the rotating wheel 204 by a vacuum rail 40.

A filling system is provided adjacent the outer circumferential surface of rotating wheel 204 in order to direct granular particles into the pockets 210 of rotating wheel 204. The filling system includes a vertical drop chute 400 and a filling chamber 300. Granules or particles 410 fall through the vertical drop chute between guide vanes 402. The vertical drop chute preferably has a length such that particles entering the filling chamber 300 from the vertical drop chute 400 are traveling at a speed approximately the same as the surface speed of rotating wheel 204. This feature increases the likelihood of a complete filling of the pockets 210 without undesirable pulverization of the particles.

Rotating wheel 204 includes spaced-apart pockets 210 that are generally conical in shape and diverge radially inwardly from an outer circumferential surface of rotating wheel 204 to an inner circumferential surface terminating at a perforated band or screen 214. The perforated band or screen 214 is clamped against the inner circumferential surface of rotating wheel 204 by a flexible segmented clamp ring 220. The segmented clamp ring 220 is provided with spaced openings 222 that coincide with the pockets 210 in the outer rotating wheel 204.

When a pocket 210 in outer rotating wheel 204 reaches position A, as show in FIG. 2, a vacuum is created in the pocket as a result of the connection between the central stationary vacuum plenum 110 and the pocket through an opening 222 in segmented clamp ring 220 and through the perforated band or screen 214. The vacuum is maintained in the pocket 210 as the rotating wheel 204 continues to rotate until the pocket is in line with position B, as shown in FIG. 2. As a pocket 210 rotates past the position B in a clockwise direction, as shown in FIG. 2, the pocket is no longer connected to the vacuum plenum 110 through a corresponding opening 222 in segmented clamp ring 220. In order to assist in the rapid emptying of particles from the pocket 210, in addition to releasing the vacuum supplied to the pocket as a result of the pocket passing the end of stationary central vacuum plenum 110, an air jet 130 can also be provided in the central stationary drum 100 as shown in FIG. 2. Clockwise rotation of outer wheel 204 moves a pocket 210 from radial alignment with central vacuum plenum 110 to radial alignment with the air jet 130. The air jet 130 provides a blast of air through an opening 222 in segmented clamp ring 220, and through the perforated band 214 to assist in emptying particles from the pocket 210.

Granules or particles 410 dropping from the vertical drop chute 400 into filling chamber 300 can be deflected toward the pockets 210 in rotating wheel 204 by deflector guide vanes 340. The vacuum that is pulled through the pockets 210 positioned along the side 304 of filling chamber 300 also results in a cross air flow through the filling chamber 300 as air is sucked in through inlets 320 on the opposite side 308 of filling chamber 300. The cross air flow through filling chamber 300 and deflector vanes 340 assists filling of each pocket 210 with the granules or particles 410 as wheel 204 rotates clockwise in FIG. 2. A scraper 360 can also be provided near the bottom 306 of filling chamber 300 and in contact with the outer circumferential surface 202 of rotating wheel 204. The scraper 360 removes excess particles from the outer circumferential surface 202 of rotating wheel 204, to thereby provide a desired amount of particles in each of the pockets 210. The excess particles drop from the bottom 306 of filling chamber 300, and can be recycled.

As each pocket 210 rotates clockwise past the bottom of the filling chamber 300, the granules or particles 410 are retained within the pocket as a result of the vacuum from vacuum plenum 110 until the pocket 210 reaches position B, as shown in FIG. 2. As a pocket 210 continues past position B in a clockwise direction, the vacuum from central vacuum plenum 110 is no longer communicated through segmented clamp ring 220 to the pocket, and the air jet 130 provides a burst of air to empty the particles from the pocket 210.

A cavity 7 in article 30 passes underneath the rotating wheel 204 in synchronization with the pockets 210 such that the cavity 7 is aligned with a pocket 210 when the particles are emptied from the pocket by air jet 130. If the cavity 7 is defined by a porous material such as the paper in a cigarette filter rod, a vacuum can be applied at this point below the cavity 7 in order to assist in filling the cavity with particles from the pocket 210. The vacuum rail 40 provided below the article 30 having cavities 7 can include one or more chambers having relatively higher vacuum 44 and use one or more chambers having relatively lower vacuum 42. The high vacuum chamber 44 can be positioned to align with the pocket 210 that is being emptied of particles 410. Auxiliary air flow around the article 30 can also be provided by lower vacuum chambers along vacuum rail 40 in order to ensure that any excess particles are cleaned from the surface of the article 30. The communication of vacuum from vacuum chamber 44 to the cavity 7 passing beneath the air jet 130 contributes to a positive withdrawal of granules or particles 410 from the pocket 210 of wheel 204 into the cavity 7. The vacuum positively retains the granules or particles in the cavity 7 as well as clearing any loose particles from the external surfaces of the article 30.

In the case of filling cavities in a cigarette filter rod with granules or particles such as charcoal, the filter rod can be completed after filling each cavity 7 with particles by the application of an adhesive along edge portions of the filter wrap defining the cavities 7. The filter wrap is then sealed as the filter rod continues downstream from the point at which each cavity is filled.

One skilled in the art will appreciate that the present invention may be practiced by embodiments other than the above-described embodiments, which have been presented for purposes of illustration and not of limitation. The device and methodologies embodied in the above-described embodiments are adaptable to delivering various types of particulate or granular material and could be used in applications other than the filling of portions of cigarette filters. For example, the device is readily adaptable to the filling of pharmaceutical doses, or the repetitive displacement of powdered food stuffs or other powdered, granular or particulate products into discrete packaging or containers.

What is claimed is:

1. An apparatus for filling at least one cavity in an article with granular or particulate material, said apparatus comprising:

a filling chamber containing the material;

a rotating wheel having at least one pocket defined in an outer circumferential surface, said at least one pocket receiving the material in the filling chamber and the outer circumferential surface defining at least part of a lateral side of said filling chamber;

a conveying device adapted to position at least one article having at least one cavity to be filled with said material underneath said wheel to receive said material from said at least one pocket;

a chute configured to supply the material to the filling chamber along path adjacent to the wheel, wherein the chute has a length such that the material entering said filling chamber from said chute is traveling at a velocity approximately equal to the velocity of the pockets on the outer circumferential surface of the wheel, wherein guide vanes are provided within said filling chamber for directing the material toward said pockets in said wheel.

2. A method of filling a cavity in an article with granular material, said method comprising:

providing a wheel rotatable around a stationary drum defining a vacuum chamber, said wheel having at least one pocket defined in its outer periphery, and at least a portion of the outer periphery of said wheel defining at least a portion of one lateral side of a filling chamber;

rotating said wheel around said stationary drum and creating a vacuum in said vacuum chamber;

dropping said material into said filling chamber, and communicating said vacuum to said at least one pocket over a distance from when said at least one pocket is positioned along said one side of said filling chamber and interrupting said vacuum at a point at which material in said at least one pocket is transferred to a cavity in an article, wherein said wheel and said filling chamber are part of a first insertion station, and said material is transferred to the cavity in said article to at least partially fill said cavity;

moving said article such that said at least partially filled cavity is positioned under a second insertion station downstream from said first insertion station in the direction of movement of said article and topping off said cavity with additional material from said second insertion station.

3. An apparatus for filling at least one cavity in an article with granular or particulate material, said apparatus comprising:

a filling chamber containing the material;

a rotating wheel having at least one pocket defined in an outer circumferential surface, said at least one pocket receiving the material in the filling chamber and the outer circumferential surface defining at least part of a lateral side of said filling chamber; and a conveying device adapted to position at least one article having at least one cavity to be filled with said material underneath said wheel to receive said material from said at least one pocket, wherein a first insertion station comprises said filling chamber and said rotating wheel, said first insertion station adapted to at least partially fill said at least one cavity of said at least one article with the material; and said apparatus further including a second insertion station comprising other filling chamber and rotating wheel adapted to top off said at least partially filled cavity with additional material.

4. The apparatus according to claim 3, further including a stationary drum positioned inside of at least one of said rotating wheels and defining a vacuum chamber in communication with said at least one pocket over a predetermined distance of rotation of said at least one of said rotating wheels.

5. The apparatus according to claim 3, wherein the at least one pocket comprises a plurality of radially inwardly diverging pockets defined in the outer circumferential surface of at least one of said rotating wheels, with a radially inner extent of said pockets being defined by a single perforated band or screen positioned against the inner circumferential surface of said at least one of said rotating wheels.

6. The apparatus according to claim 3, further comprising a chute configured to supply the material to at least one of the filling chambers along a path adjacent to at least one of the rotating wheels.

7. The apparatus according to claim 5 wherein said perforated band or screen is clamped against the inner circumferential surface of said at least one of said rotating wheels by a clamp ring positioned inside the wheel.

8. The apparatus according to claim 6, wherein the chute has a length such that the material entering said at least one said filling chambers from said chute is traveling at a velocity approximately equal to the velocity of the pockets on the outer circumferential surface of said at least one of the rotating wheels.

9. The apparatus according to claim 8, wherein guide vanes are provided within said at least one of said filling chambers for directing the material toward said pockets in said at least one of the rotating wheels.

10. The apparatus according to claim 3, wherein said conveying device includes at least one vacuum chamber for drawing the material into the at least one cavity from the at least one of the rotating wheels.

11. The apparatus according to claim 10, wherein said conveying device includes at least one chamber having relatively higher vacuum and at least one chamber having relatively lower vacuum, with the at least one higher vacuum chamber being positioned underneath a cavity being filled with material from a pocket in said at least one of the rotating wheels.

* * * * *